US008056259B2

(12) United States Patent
Kim

(10) Patent No.: US 8,056,259 B2
(45) Date of Patent: Nov. 15, 2011

(54) AIR CUSHION SHOE SOLE

(76) Inventor: Young seok Kim, Busan (KR)

( * ) Notice: Subject to any disclaimer, the term of this patent is extended or adjusted under 35 U.S.C. 154(b) by 487 days.

(21) Appl. No.: 12/317,978

(22) Filed: Dec. 31, 2008

(65) Prior Publication Data

US 2010/0050471 A1 Mar. 4, 2010

(30) Foreign Application Priority Data

Aug. 26, 2008 (KR) ..... 10-2008-0083527

(51) Int. Cl.
*A43B 7/06* (2006.01)

(52) U.S. Cl. ..... 36/3 R; 36/3 B; 36/29

(58) Field of Classification Search ..... 36/3 R, 36/3 B, 29, 30 R, 59 C
See application file for complete search history.

(56) References Cited

U.S. PATENT DOCUMENTS

| | | | | |
|---|---|---|---|---|
| 4,654,982 | A * | 4/1987 | Lee | 36/3 R |
| 2005/0005473 | A1* | 1/2005 | Oh | 36/29 |
| 2005/0160623 | A1* | 7/2005 | Liou | 36/3 B |
| 2007/0011908 | A1* | 1/2007 | Huang et al. | 36/3 B |
| 2007/0094891 | A1* | 5/2007 | Myslinski | 36/3 R |
| 2007/0294923 | A1* | 12/2007 | Hayakawa | 36/3 B |
| 2009/0119949 | A1* | 5/2009 | Song | 36/103 |

* cited by examiner

*Primary Examiner* — Marie Patterson
(74) *Attorney, Agent, or Firm* — Jordan and Hamburg LLP

(57) ABSTRACT

An air cushion shoe has an air chamber at an upper surface of a front side of a main body. An air passageway extends from the air chamber to an air inlet. Air pockets are formed in the main body at predetermined positions below the air passageway. First air vents are formed at a front side of the hardened reinforcement sheet positioned onto the main body to cover the open upper portions of the air passageway and the air pockets. Second air vents are formed at a front side of a main body of a shoe liner. A cushioning material having a honeycomb structured body is formed at the bottom surface of the main body.

1 Claim, 4 Drawing Sheets

AIR CUSHION SHOE SOLE

BACKGROUND OF THE INVENTION

1. Field of the Invention

The present invention relates generally to an air cushion shoe sole, and more particularly to an air cushion shoe sole capable of providing good elastic air cushioning and shock-absorbing effects for relieving foot pressure during the entire walking gait cycle of a wearer, wherein an air chamber is formed in an upper surface of the front side of the main body, wherein an air passageway extends from the rear side of the air chamber to an air inlet formed at a rear side edge of the shoe sole, wherein pluralities of air pockets are formed in the main body at predetermined positions below the air passageway, wherein pluralities of first air vents are formed at the front side of a hardened reinforcement sheet, in which the hardened reinforcement sheet is positioned onto the upper surface of the main body in a manner that it has an extended warranty to cover the open upper portion of air passageway and the open upper portions of the air pockets, wherein pluralities of second air vents are formed at the front side of the main body of a shoe liner, and wherein a cushioning material having a honeycomb structured body is formed at the bottom surface of the main body of the shoe liner.

2. Description of the Prior Art

A variety of air cushion shoe soles for providing a wearer with comfortable feelings and elastic air cushioning effects by introducing the air into the shoe have been proposed.

For example, an air cushion shoe sole according to the prior art is provided with an upper shoe sole and a lower shoe sole, which are formed as a separate piece and then combined with each other by using an adhesive so as to form an integral shoe sole. Pluralities of cushion parts are formed through the boundary region between the upper shoe sole and the lower shoe sole in a manner to have a tunnel shape. Pluralities of through holes are formed through the upper shoe sole in the corresponding area of the cushion parts.

If a user walks along the street with wearing on a shoe employing the air cushion shoe sole according to the prior art, the shoe sole comprising the upper and the lower shoe soles may be compressed and expand repeatedly and thereby it performs an air cushioning action due to the structure and the operation of the cushion parts having a tunnel shape. During air cushioning action, the air may be introduced into the shoe through the upper shoe sole having the through holes which are fluid-communicated with the cushion parts.

Since the shoe employing the air cushion shoe sole according to the prior art has the cushion parts which are formed through the boundary region between the upper shoe sole and the lower shoe sole in the horizontal direction, it may permeable to water in the rain or during cross the pool of water. When a user walks in the rain or during cross the pool of water with wearing on a shoe employing the air cushion shoe sole according to the prior art, water may be introduced into the cushion parts at first and then it may flow upwards via the through holes and thereby the foot of the wearer gets wet.

Alternatively, for example, an air cushion shoe sole according to the prior art can be provided with an air bag or a shock-absorbing spring therein so as to provide the wearer with a cushion effect. Although the air bag or the shock-absorbing spring can provide the wearer with good cushion effect, they must be separately manufactured and then must be installed by using some tools for fixing them in the shoe sole. One drawback of using the air bag or the shock-absorbing spring is that the manufacturing process may require a large number of parts and additional manufacturing steps, thereby resulting in the generation of excess manufacturing cost. Also, the weight of the shoe may be increased.

Another drawback of such known shoe sole is that the shock-absorbing spring made of a metal material is apt to damage the shoe sole and thereby resulting in the rupture of the shoe. Another drawback of such known shoe sole is that the shock-absorbing spring made of a metal material is apt to generate an unbearable noise and thereby it gives the wearer an unpleasant feeling during the entire walking gait cycle of a wearer.

SUMMARY OF THE INVENTION

In consideration of the above-mentioned disadvantages or inconveniences of the conventional shoe sole, an object of the present invention is to provide an air cushion shoe sole capable of providing good elastic air cushioning and shock-absorbing effects for relieving foot pressure during the entire walking gait cycle of a wearer, wherein an air chamber is formed in an upper surface of the front side of the main body, wherein an air passageway extends from the rear side of the air chamber to an air inlet formed at a rear side edge of the shoe sole, wherein pluralities of air pockets are formed in the main body at predetermined positions below the air passageway, wherein pluralities of first air vents are formed at the front side of a hardened reinforcement sheet, in which the hardened reinforcement sheet is positioned onto the upper surface of the main body in a manner that it has an extended warranty to cover the open upper portion of air passageway and the open upper portions of the air pockets, wherein pluralities of second air vents are formed at the front side of the main body of a shoe liner, and wherein a cushioning material having a honeycomb structured body is formed at the bottom surface of the main body of the shoe liner.

In order to achieve the object, the present invention provides an air cushion shoe sole of the type in which a hardened reinforcement sheet is disposed at the total upper surface of a main body and a shoe liner is detachably positioned at an upper surface of the hardened reinforcement sheet, the improvement comprising:

a non-slip cushion sheet being integrally formed with a bottom surface of the main body;

a nonskid member being positioned into a recess formed at the bottom surface of the main body;

an air chamber being formed at the upper surface of a front side of the main body, the air chamber having an open upper portion;

an air passageway extending from a rear side of the air chamber to a first air inlet formed at a rear side edge, the air passageway having an open upper portion;

pluralities of air pockets being formed in the main body at predetermined positions below the air passageway, the air pockets having a open upper portion, respectively;

pluralities of first air vents being formed at a front side of the hardened reinforcement sheet, the first air vents being fluid-communicated with the air chamber;

the hardened reinforcement sheet being positioned onto the upper surface of the main body in a manner that it has an extended warranty to cover the open upper portion of air passageway and the open upper portions of the air pockets;

pluralities of second air vents being formed at a front side of a main body of the shoe liner, the second air vents being fluid-communicated with the first air vent of the hardened reinforcement sheet; and a cushioning material having a honeycomb structured body being formed at the bottom surface of the main body, in which the honeycomb-shaped grooves are formed in a row and has a open lower portion, respectively.

As described above, the air cushion shoe sole according to the present invention has significant advantages over previously known shoe sole. In the air cushion shoe sole according to the present invention, the plurality of air pockets and the air chamber having the air passageway are provided in the main body of the shoe sole, and the hardened reinforcement sheet is positioned onto the upper surface of the main body in a manner that it has an extended warranty to cover the open upper portion of air passageway and the open upper portions of the air pockets. Due to the constitution of the shoe sole as described above, the air may be collected in the air chamber at first and then it may be introduced into the interior of the shoe via the hardened reinforcement sheet and the shoe liner. Due to the existence of the air chamber, the air pockets and the air passageway, total volume of the shoe sole may be reduced and thereby resulting in weight reduction of the shoe. Also, it gives a considerable reduction in manufacturing costs.

By virtue of the manufacture of the main body of the shoe sole, which can be made of a foam rubber, while affording the same shock absorbing effect, the damage of the shoe sole can be substantially less than was hitherto the case. By virtue of simple installation of the non-slip cushion sheet at the bottom surface of the shoe sole, total structure of the shoe sole can be substantially simpler than was hitherto the case. By virtue of simple installation of the nonskid member at the bottom surface of the shoe sole, it is possible to prevent the foot of a wearer from slipping during the entire walking gait cycle of the wearer, thereby providing good bottom support, elastic air cushioning and shock-absorbing effects for relieving foot pressure.

BRIEF DESCRIPTION OF THE DRAWINGS

The above object and other characteristics and advantages of the present invention will become more apparent by describing in detail a preferred embodiment thereof with reference to the attached drawings, in which.

DETAILED DESCRIPTION OF THE INVENTION

Figure 1:
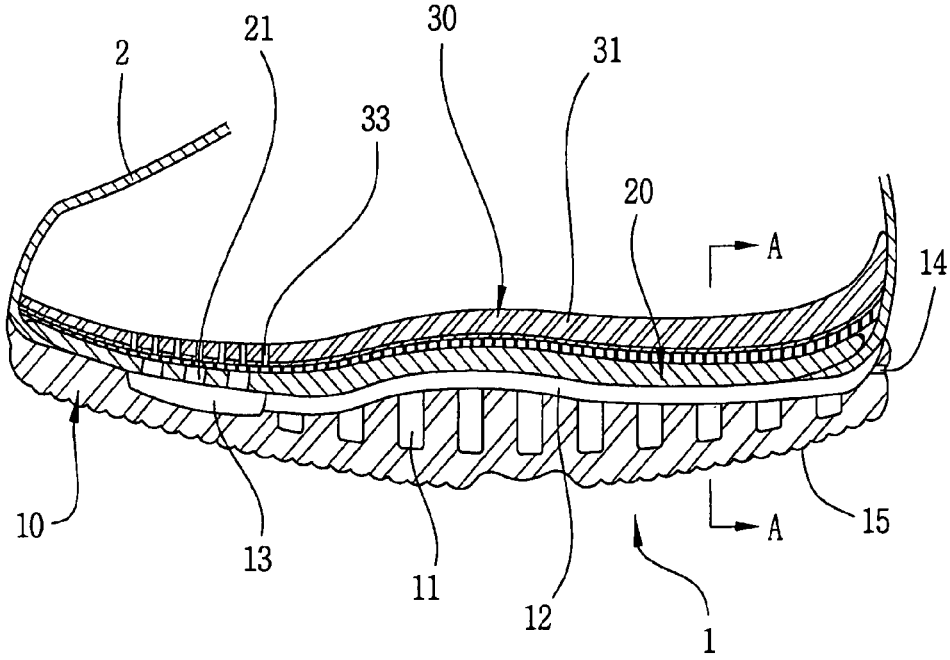
FIG. 1 is a longitudinal sectional view of an air cushion shoe sole according to the preferred embodiment of the present invention.

Hereinafter, the constitution and the operation of an air cushion shoe sole according to the preferred embodiment of the present invention will be explained in more detail with reference to the accompanying drawings FIGS. 1 to 7.

Prior to proceeding to the more detailed description of the preferred embodiment according to the present invention, it should be noted that, for the sake of clarity and understanding of the invention identical components which have identical functions have been identified with identical reference numerals throughout the different views which are illustrated in each of the attached drawing Figures.

Figure 2:
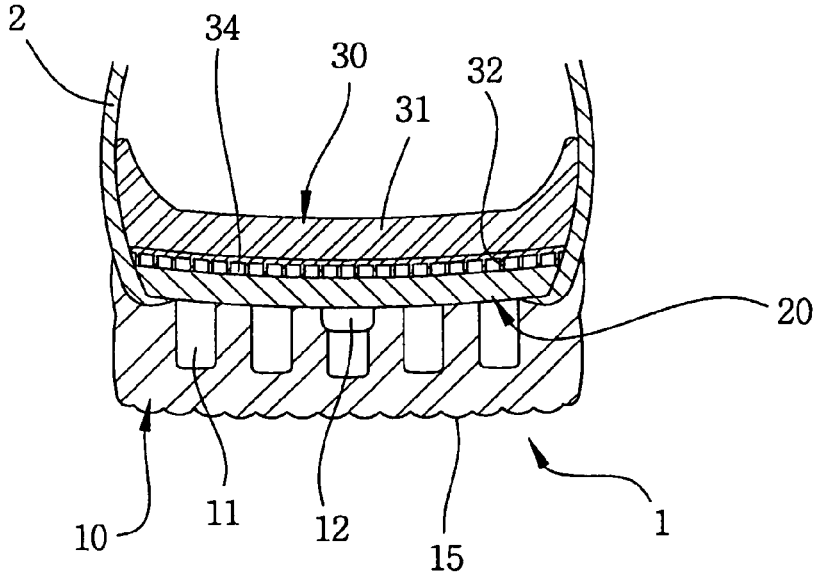
FIG. 2 is a sectional view taken along line "A-A" shown in FIG. 1.

As will be best seen in FIGS. 1 and 2, this invention relates to the air cushion shoe sole 1 has a substantially arc shape on the whole of which front and rear portions are slanted upwards at a predetermined angle of inclination. The shoe sole 1 comprises a hardened reinforcement sheet 20 which is disposed onto the upper surface of a main body 10 of the shoe sole 1. The shoe sole 1 also comprises a shoe liner 30 made of a soft material, which is detachably positioned onto an upper surface of the hardened reinforcement sheet 20. If a user puts on wear a shoe employing the shoe sole 1 according to the present invention, the upper surface of the shoe liner 30 may be touched with the sole of the user's foot.

The main body 10 is made of a foam rubber material of which hydrolysis may not be occurred. A non-slip cushion sheet 15 is attached to a bottom surface of the main body 10. Referring now to the drawings FIGS. 4 and 7, a recess 16 is formed at the bottom surface of the main body 10 at a predetermined position. A nonskid member 17 is inserted into the recess 16 and fixed therein.

Preferably, the nonskid member 17 may be made by mixing a soft synthetic resin or a synthetic rubber material with some abrasive material such as sand. Alternatively, the nonskid member 17 can be made of tough raw rubber.

Figure 3:
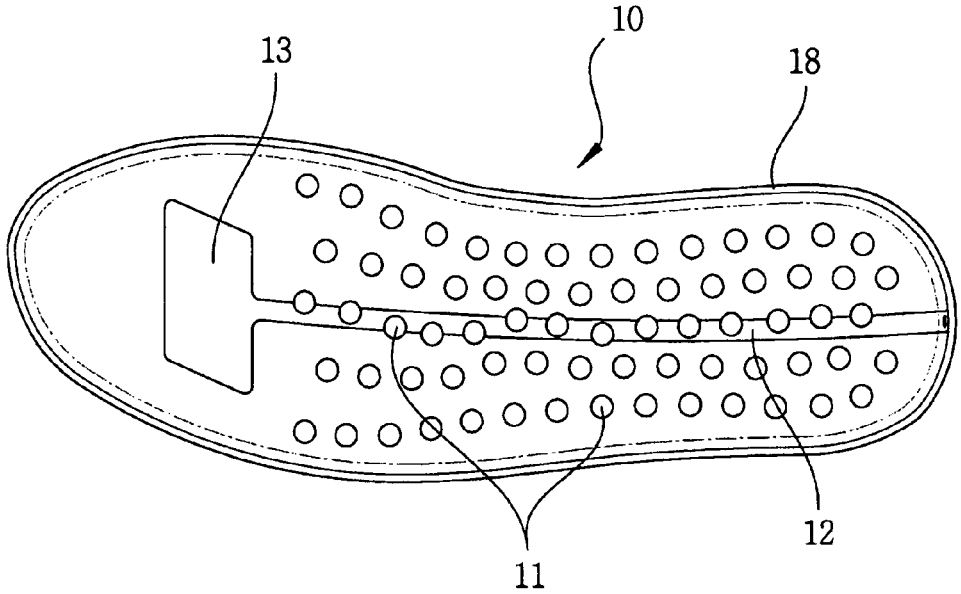
FIG. 3 is a plan view of a main body for the air cushion shoe sole according to the preferred embodiment of the present invention.

As best seen in FIGS. 1 to 3, an air chamber 13 is provided at an upper surface of the main body 10 in a manner to positionally correspond to an approximate front portion of the user's foot. An air inlet 14 for introducing the air is provided at a rear side edge 18 of the main body 10. An air passageway 12 longitudinally extends between the air chamber 13 and the air inlet 14.

Pluralities of air pockets 11 are provided at certain positions between the air chamber 13 and the air inlet 14 at the upper surface of the main body 10 in a manner to have a different depth. Upper portions of the air pockets 11 are open.

The hardened reinforcement sheet 20 is positioned onto the upper surface of the main body 10 in a manner to cover the total upper surface. Pluralities of air vents 21 are formed at the front side of the hardened reinforcement sheet 20 in a manner to fluid-communicated with the air chamber 13. If the hardened reinforcement sheet 20 is positioned onto the upper surface of the main body 10, it may block pluralities of air pockets 11, the air passageway 12 and the air chamber 13. Since the height of air pocket 11 formed at the bottom surface of the air passageway 12 is relatively smaller than that of the air passageway 12 or the air chamber 13, the bottom surface of the hardened reinforcement sheet 20 cannot completely block the upper surface of the air pocket 11. Therefore, a certain quantity of air may be filled in the air pockets 11.

As described above, the shoe liner 30 is made of a soft material and is detachably attached to the upper surface of the hardened reinforcement sheet 20. Pluralities of second air vents 33 are formed at a front side of a main body 31 of the shoe liner 30 in a manner to fluid-communicated with the first air vents 21 of the hardened reinforcement sheet 20. A cushioning material 32 having a honeycomb structured body is formed at the bottom surface of the main body 31. This cushioning material 32 is made of a soft synthetic resin and has honeycomb-shaped grooves 34 which are formed in a row.

A lower part of the cushioning material 32 is open so that the lower portion of the honeycomb-shaped groove 34 is also open. The depth of the honeycomb-shaped groove 34 is gradually increased toward the heel zone of the air cushion shoe sole 1 so that it may allow for effectively absorbing a user' weight during walking gait cycle.

The reference numeral "2" is corresponding to a shoe sheath. The reference numeral "19" is corresponding to a decorative design member or logo configured to affix to the heel zone of the air cushion shoe sole 1.

Having described air cushion shoe sole according to the preferred embodiment of the present invention in detail, the operation of the shoe sole 1 can be understood as follows with reference to FIGS. 1 to 7.

If a person puts on a shoe employing the air cushion shoe sole 1 as described above and walks on a road with accompanying rolling of the foot, then the heal zone of the shoe may be touched with the ground. At this time, the main body 10 may expand and contract repeatedly in a manner to perform the shock damping action and the pumping action.

As described above, pluralities of air pockets 11 are provided at certain positions between the air chamber 13 and the air inlet 14 at the upper surface of the main body 10 in a manner to have a different depth. The hardened reinforcement sheet 20 is positioned onto the upper surface of the main body 10 in a manner to cover the total upper surface. At this time, since the height of air pocket 11 formed at the bottom surface of the air passageway 12 is relatively smaller than that of the air passageway 12 or the air chamber 13, the bottom surface of the hardened reinforcement sheet 20 cannot completely block the upper surface of the air pocket 11. Therefore, a certain quantity of air may be filled in the air pockets 11. Consequently, the air pockets 11 may expand and contract repeatedly to perform the shock damping action and the pumping action in the same manner as the operation of the air bag.

Because of the air pockets 11 are provided at certain positions between the air chamber 13 and the air inlet 14 at the upper surface of the main body 10 in a manner to have a different depth, the total weight of the main body 10 may be relieved as much as the total volume of the air pockets 11. It is foreseen that the main body 10 is made of an elastic rubber material and has an inherent elasticity. Add to this, the air pockets 11 further provide the elasticity because of it contains a certain quantity of air. Consequently, it can provide good air cushion effect at the time that the shoe is contacted with the ground during walking and the accompanying rolling of the foot.

If a person walks along the street with wearing on a shoe employing the air cushion shoe sole according to the present invention, the main body 10 may be compressed at first. At this time, the air contained in the air pockets 11 may be also compressed and thereby it can provide good air cushion effect at the time that the shoe is contacted with the ground.

If the main body 10 is compressed during walking and the accompanying rolling of the foot, the air contained in the air pockets 11, the air passageway 12 and the air chamber 13 may be also compressed. At this time, the air may be exhausted through a relatively low-pressure side. The first air inlet 14 formed at the rear side of the air passageway 12 is a one through hole having a relatively small size. As described above, pluralities of first air vents 21 are formed at the front side of the hardened reinforcement sheet 20 in a manner to fluid-communicated with the air chamber 13. Since the total size of the first air vents 21 is larger than the size of the air inlet 14, the air contained in the air pockets 11, the air passageway 12 and the air chamber 13 may be exhausted through the first air vents 21.

Since pluralities of second air vents 33 are formed at a front side of the main body 31 of the shoe liner 30 in a manner to fluid-communicated with the first air vents 21 of the hardened reinforcement sheet 20, the air ascending through the first air vents 21 of the hardened reinforcement sheet 20 may be introduced into the interior of the shoe through the second air vents 33 of the shoe liner 30. Consequently, the wearer of the shoe may feel refreshed and be comfortable due to supply of the air.

If the wearer raise up his or her foot from the ground during the entire walking and the accompanying rolling of the foot, the foot pressure applied to the main body 10 may disappear. At the same time, the main body 10 begins to expand due to the air cushion action of the air pocket 11 and its restoring force of the main body 10.

If the main body 10 expands, the air may be introduced into the air passageway 12 via the air inlet 14. Then, pluralities of air pockets 11 provided below the air passageway 12 and the air chamber 13 may be filled with the air.

As described above, when a user walks along the street with wearing on a shoe employing the air cushion shoe sole 1 according to the present invention, the main body 10 is compressed and expands repeatedly and thereby it performs an air cushioning operation and a pumping operation. Since the cushioning material 32 having a honeycomb structured body is formed at the bottom surface of the main body 31 as shown in FIGS. 1, 2 and 5, 6, it may allow for effectively absorbing a user' weight during walking gait cycle.

As described above, the cushioning material 32 has honeycomb-shaped grooves 34 which are formed in a row. The open lower portion of the honeycomb-shaped grooves 34 is blocked by the upper surface of the hardened reinforcement sheet 20 so that the honeycomb-shaped grooves 34 can perform the shock damping action and the pumping action in the same manner as the operation of the air pockets. Since pluralities of honeycomb-shaped grooves 34 are formed in a row, the user's weight resting on the shoe liner 30 can be uniformly distributed and elastically supported with providing the sole of the foot with a uniform cushion.

As described above, the non-slip cushion sheet 15 is integrally formed with the main body 10. The non-slip cushion sheet 15 is made of foam rubber which is the same as that of the main body 10. Accordingly, there is nothing to worry about that the additional non-slip cushion sheet employed in the conventional shoe sole may be easily detached from the bottom surface of the shoe sole. Also, it is not required to have additional process for attaching the non-slip cushion sheet to the bottom surface of the shoe sole so that the terms of manufacturing process can be reduced. Additionally, it is possible to obtain an extended warranty to cover any damages or malfunctions that may occur during the manufacturing process. In addition, since the main body 10 is made of foam rubber, there is no hydrolysis.

Figure 4:
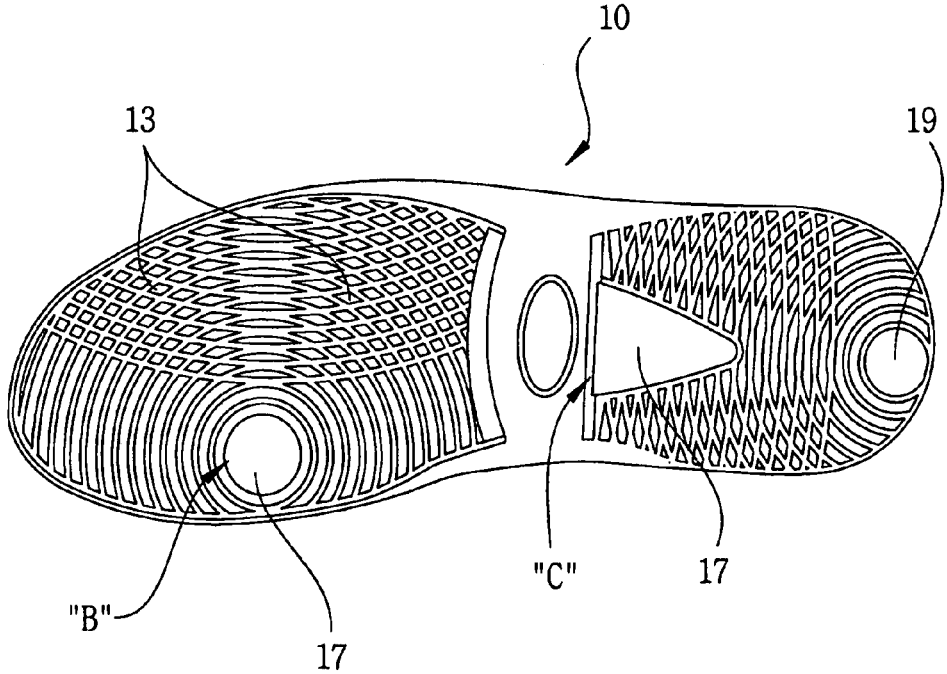
FIG. 4 is a bottom view of the main body for the air cushion shoe sole according to the preferred embodiment of the present invention.
Figure 5:
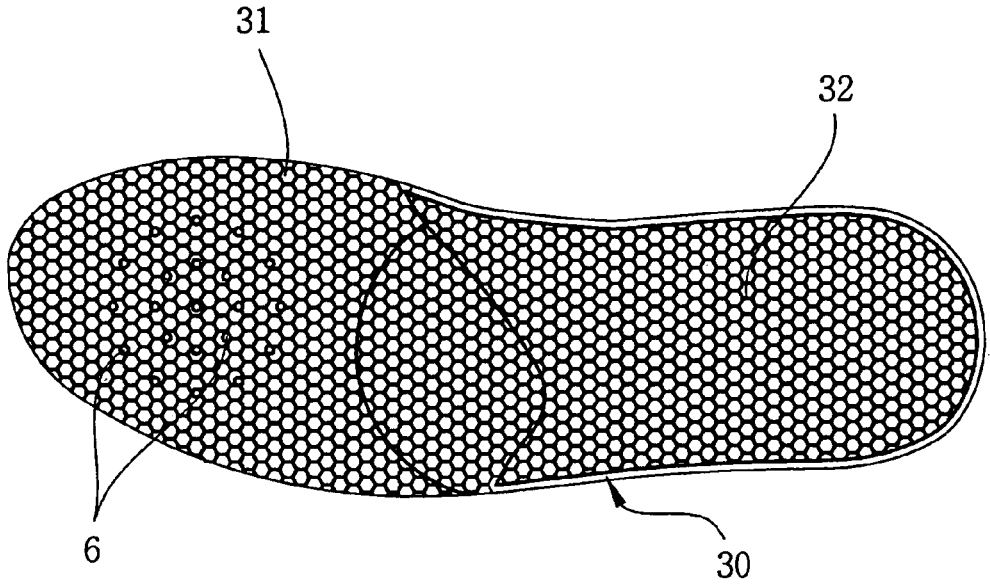
FIG. 5 is a bottom view of a shoe liner for the air cushion shoe sole according to the preferred embodiment of the present invention.
Figure 6:
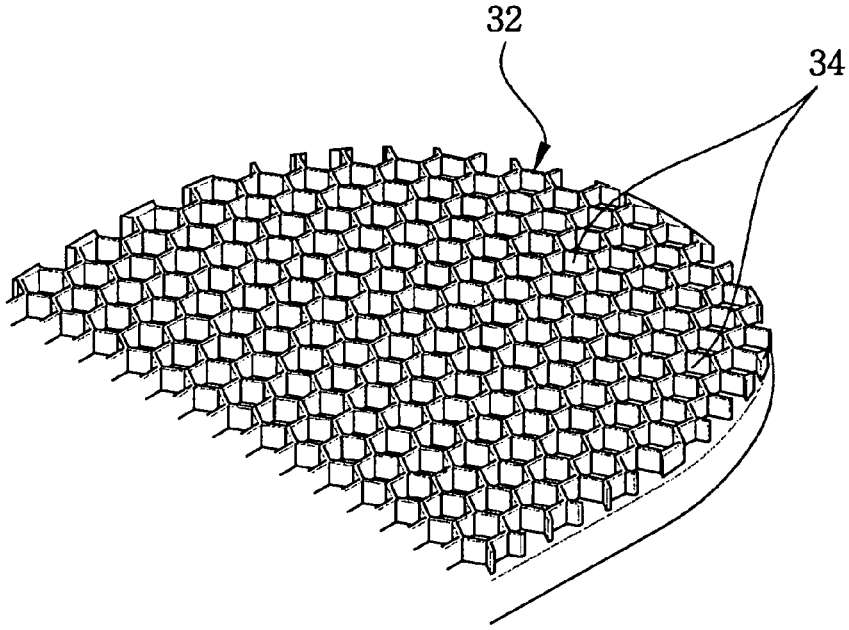
FIG. 6 is an enlarged perspective view of a rear portion of the shoe liner shown in FIG. 5.
Figure 7:
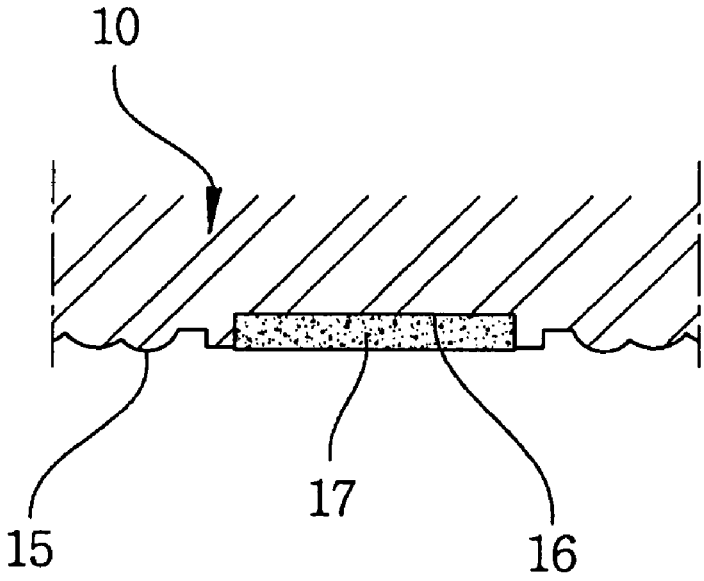
FIG. 7 is a partial sectional view for illustrating the invention with a nonskid member in different operative positions, "B" and "C" shown in FIG. 4.

Since the non-slip cushion sheet 15 is formed at the bottom surface of the main body 10 and the nonskid member 17 is attached to the bottom surface of the main body 10 as shown in FIGS. 4 and 7, it can give good bottom support and excellent non-slip effects during the entire walking gait cycle of the wearer. In more detail, the nonskid member 17 is positioned into the recess 16 formed at the bottom surface of the main body 10 and then it is fixed therein by using an adhesive.

Due to the constitution of the air cushion shoe sole as described above, it is possible to prevent the foot of a wearer from slipping during the entire walking gait cycle, thereby providing good bottom support, elastic air cushioning and shock-absorbing effects for relieving foot pressure.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An air cushion shoe sole, comprising:

a tread member having a tread member upper surface, a tread member bottom surface with a tread formed thereon, a toe end, and a heel end, the tread member having a tread length extending from the toe end to the heel end;

a hardened reinforcement sheet disposed over the tread member upper surface and extending substantially over the tread length, the hardened reinforcement sheet having a reinforcement sheet upper surface and a reinforcement sheet lower surface;

a shoe liner detachably positioned at the reinforcement sheet upper surface in an unbonded state so as to be freely removable;

the tread being formed as a non-slip cushion sheet integrally formed with the tread member at the tread member bottom surface;

a nonskid member disposed in a recess formed in the tread member bottom surface;

an air chamber formed in the tread member upper surface proximate said toe end, the air chamber being a first recess having a first recess opening;

an air passageway extending from a rear side of the air chamber to a first air inlet formed at the heel end of the tread member, the air passageway being formed as a second recess in the tread member upper surface and defining a second recess opening and a second recess bottom;

air pockets formed in the tread member main at predetermined positions below the air passageway, the air pockets being third recesses formed in the tread member having third recess openings formed at least in part by the second recess bottom;

first air vents formed in the hardened reinforcement sheet proximate said toe end, the first air vents being fluid-communicated with the air chamber;

the hardened reinforcement sheet being positioned onto the tread member upper surface to cover the second recess opening of the air passageway and the third recess openings of the air pockets;

said shoe liner including a shoe liner main body having second air vents formed in the shoe liner main body proximate said toe end, the second air vents being fluid-communicated with the first air vents of the hardened reinforcement sheet, the shoe liner main body having a shoe liner upper surface and a shoe liner bottom surface, the second air vents communicating from the shoe liner upper surface to the shoe liner bottom surface with the shoe liner being configured such that the air cushion sole expels air through the second air vent to outside the shoe liner and into an interior of a shoe; and a cushioning layer having a honeycomb structured body at the shoe liner bottom surface, the honeycomb structured body having honeycomb-shaped grooves are formed in rows and open to a lower surface of the cushioning layer.

* * * * *